US010276103B2

(12) United States Patent
Park et al.

(10) Patent No.: US 10,276,103 B2
(45) Date of Patent: Apr. 30, 2019

(54) STAGE AND DISPLAY DEVICE USING THE SAME

(71) Applicant: SAMSUNG DISPLAY CO., LTD., Yongin-si, Gyeonggi-do (KR)

(72) Inventors: Jun Hyun Park, Yongin-si (KR); Sung Hwan Kim, Yongin-si (KR); Byung Geun Jun, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 92 days.

(21) Appl. No.: 15/647,703

(22) Filed: Jul. 12, 2017

(65) Prior Publication Data

US 2018/0018921 A1 Jan. 18, 2018

(30) Foreign Application Priority Data

Jul. 13, 2016 (KR) ..... 10-2016-0088536

(51) Int. Cl.
*G09G 3/3266* (2016.01)

(52) U.S. Cl.
CPC ... *G09G 3/3266* (2013.01); *G09G 2310/0221* (2013.01)

(58) Field of Classification Search
USPC ..... 345/100
See application file for complete search history.

(56) References Cited

U.S. PATENT DOCUMENTS

| | | | | |
|---|---|---|---|---|
| 8,587,347 | B2 | 11/2013 | Yoon et al. | |
| 9,087,468 | B2 | 7/2015 | Yoon et al. | |
| 9,524,690 | B2 | 12/2016 | Lim et al. | |
| 2009/0040203 | A1* | 2/2009 | Kim | G09G 3/3677 345/204 |
| 2012/0105398 | A1* | 5/2012 | Park | H03K 19/018521 345/206 |

FOREIGN PATENT DOCUMENTS

| | | | |
|---|---|---|---|
| KR | 10-2013-0083151 | A | 7/2013 |
| KR | 10-2015-0086973 | A | 7/2015 |
| KR | 10-2016-0047681 | A | 5/2016 |

* cited by examiner

*Primary Examiner* — Jennifer Mehmood
*Assistant Examiner* — Deeprose Subedi
(74) *Attorney, Agent, or Firm* — Lee & Morse, P.C.

(57) ABSTRACT

A stage includes an output, first and second controllers, and first and second inputs. The output supplies a scan signal to a first output terminal and a carry signal to a second output terminal based on first and second node voltages and a first clock signal supplied to a first input terminal. The first controller controls a third node voltage based on a voltage of the second output terminal. The second controller controls the second node voltage based on the first clock signal supplied to the first input terminal and the third node voltage. The first input controls the first and third node voltages based on a carry signal of a previous stage supplied to a second input terminal. The second input controls the first and third node voltages based on the second node voltage and a carry signal of a next stage supplied to a third input terminal.

20 Claims, 6 Drawing Sheets

STAGE AND DISPLAY DEVICE USING THE SAME

CROSS-REFERENCE TO RELATED APPLICATION

Korean Patent Application No. 10-2016-0088536, filed on Jul. 13, 2016, and entitled, "Stage And Display Device Using The Same," is incorporated by reference herein in its entirety.

BACKGROUND

1. Field

One or more embodiments described herein relate to a stage and a display device using a stage.

2. Description of the Related Art

A variety of displays have been developed. Examples include liquid crystal displays and organic light emitting displays. These displays include a data driver for supplying data signals to data lines, a scan driver for supplying scan signals to scan lines, and pixels connected to the scan lines and data lines. When the scan signals are supplied to the scan lines, corresponding pixels output light based on data signals from the data lines. The scan driver may include stages for supplying the scan signals to the scan lines based on signals from a timing controller. Each stage includes p-type transistors and/or n-type transistors that are simultaneously mounted on a panel with the pixels. The stages occupy an excessive amount of space on the panel.

SUMMARY

In accordance with one or more embodiments, a stage including an output connected to a first power input terminal and a second power input terminal, the output to supply an ith (i is a natural number) scan signal to a first output terminal and an ith carry signal to a second output terminal based on a voltage of a first node, a voltage of a second node, and a first clock signal supplied to a first input terminal; a first controller connected between a second output terminal and a third node, the first controller to control a voltage of the third node based on a voltage of the second output terminal; a second controller, connected to the second power input terminal, to control the voltage of the second node based on the first clock signal supplied to the first input terminal and the voltage of the third node; a first input to control the voltages of the first node and the third node based on a carry signal of a previous stage supplied to a second input terminal; and a second input connected to the second power input terminal, the second input to control the voltages of the first node and the third node based on the voltage of the second node and a carry signal of a next stage supplied to a third input terminal.

The carry signal of the previous stage may not overlap the first clock signal. The carry signal of the previous stage may correspond to an (i−1)th carry signal. The carry signal of the next stage may be supplied in at least a first period after the ith carry signal is supplied. The first period may be a 1 horizontal period 1H. The carry signal of the next stage may correspond to an (i+2)th carry signal.

The first power input terminal may receive a first power set to have a gate-off voltage, and the second power input terminal may receive a second power set to have a gate-off voltage less than a voltage of the first power. The first power input terminal and the second power input terminal may be connected to a same power, and the same power may have a gate-off voltage.

The first controller may include a first transistor connected between the second output terminal and the third node, wherein the first transistor includes a gate electrode connected to the second output terminal. The first input may include a plurality of second transistors between the second input terminal and the first node, the second transistors diode-connected to allow current to flow from the second input terminal to the first node, and at least one common terminal between adjacent ones of the second transistors is electrically connected to the third node.

The second input may include a plurality of third transistors serially connected between the first node and the second power input terminal, the third transistors including gate electrodes connected to the third input terminal; and a plurality of fourth transistors serially connected between the first node and the second power input terminal, the fourth transistors including gate electrodes connected to the second node, wherein at least one common terminal between adjacent ones of the third transistors and at least one common terminal between adjacent ones of the fourth transistors are electrically connected to the third node.

The second controller may include a fifth transistor connected between the second node and the first input terminal, the first transistors including a gate electrode connected to first input terminal; and a sixth transistor connected between the second node and second input terminal, the sixth transistor including a gate electrode connected to the third node.

The output may include a seventh transistor connected between the first input terminal and the first output terminal, the seventh transistor including a gate electrode connected to the first node; an eighth transistor connected between the first output terminal and the first power input terminal, the eighth transistor including a gate electrode connected to the second node; a ninth transistor connected between the first input terminal and the second output terminal, the ninth transistor including a gate electrode connected to the first node; a tenth transistor connected between the second output terminal and the second power input terminal, the tenth transistor including a gate electrode connected to the second node; and a first capacitor connected between the first node and the first output terminal, wherein a size of the seventh transistor is greater than a size of the eighth transistor, and wherein a size of the ninth transistor is greater than a size of the tenth transistor.

In accordance with one or more other embodiments, a display device includes a plurality of pixels connected to scan lines and data lines; a data driver to supply data signals to the data lines; and a scan driver including a plurality of stages to supply scan signals to the scan lines, wherein an ith (i is a natural number) stage among the stages includes: an output connected to a first power input terminal and a second power input terminal, the output to supply an ith (i is a natural number) scan signal to a first output terminal and an ith carry signal to a second output terminal based on a voltage of a first node, a voltage of a second node, and a clock signal supplied to a first input terminal; a first controller connected between a second output terminal and a third node, the first controller to control a voltage of the third node based on a voltage of the second output terminal; a second controller connected to the second power input terminal, the second controller to control the voltage of the second node based on the clock signal supplied to the first input terminal and the voltage of the third node; a first input to control the voltages of the first node and the third node based on a carry signal of a previous stage supplied to a second input terminal; and a second input connected to the second power input terminal, the second input to control the voltages of the first node and the third node based on the voltage of the second node and a carry signal of a next stage supplied to a third input terminal, wherein the first power input terminal and the second power input terminal are to receive gate-off voltages.

A first clock signal may be supplied to the first input terminal of the ith stage and a second clock signal is supplied to a first input terminal of an (i+1)th stage; and the first clock signal and the second clock signal may have a same period and reversed phases. The first controller may include a first transistor connected between the second output terminal and the third node, and the first transistor including a gate electrode connected to the second output terminal.

The first input may include a plurality of second transistors between the second input terminal and the first node, the second transistors diode-connected may allow current to flow from the second input terminal to the first node, and at least one common terminal between adjacent ones of the second transistors may be electrically connected to the third node.

The second input may include a plurality of third transistors serially connected between the first node and the second power input terminal, the third transistors including gate electrodes connected to the third input terminal; and a plurality of fourth transistors serially connected between the first node and the second power input terminal, the fourth transistors including gate electrodes connected to the second node, wherein at least one common terminal between adjacent ones of the third transistors and at least one common terminal between adjacent ones of the fourth transistors are electrically connected to the third node.

The second controller may include a fifth transistor connected between the second node and the first input terminal, the fifth transistor includes a gate electrode connected to the first input terminal; and a sixth transistor connected between the second node and the second input terminal, the sixth transistor with a gate electrode connected to the third node.

The output may include a seventh transistor connected between the first input terminal and the first output terminal, the seventh transistor including a gate electrode connected to the first node; an eighth transistor connected between the first output terminal and the first power input terminal, the eighth transistor including a gate electrode connected to the second node; a ninth transistor connected between the first input terminal and the second output terminal, the ninth transistor including a gate electrode connected to the first node; a tenth transistor connected between the second output terminal and the second power input terminal, the tenth transistor including a gate electrode connected to the second node; and a first capacitor connected between the first node and the first output terminal, wherein a size of the seventh transistor is greater than a size of the eighth transistor, and wherein a size of the ninth transistor is greater than a size of the tenth transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
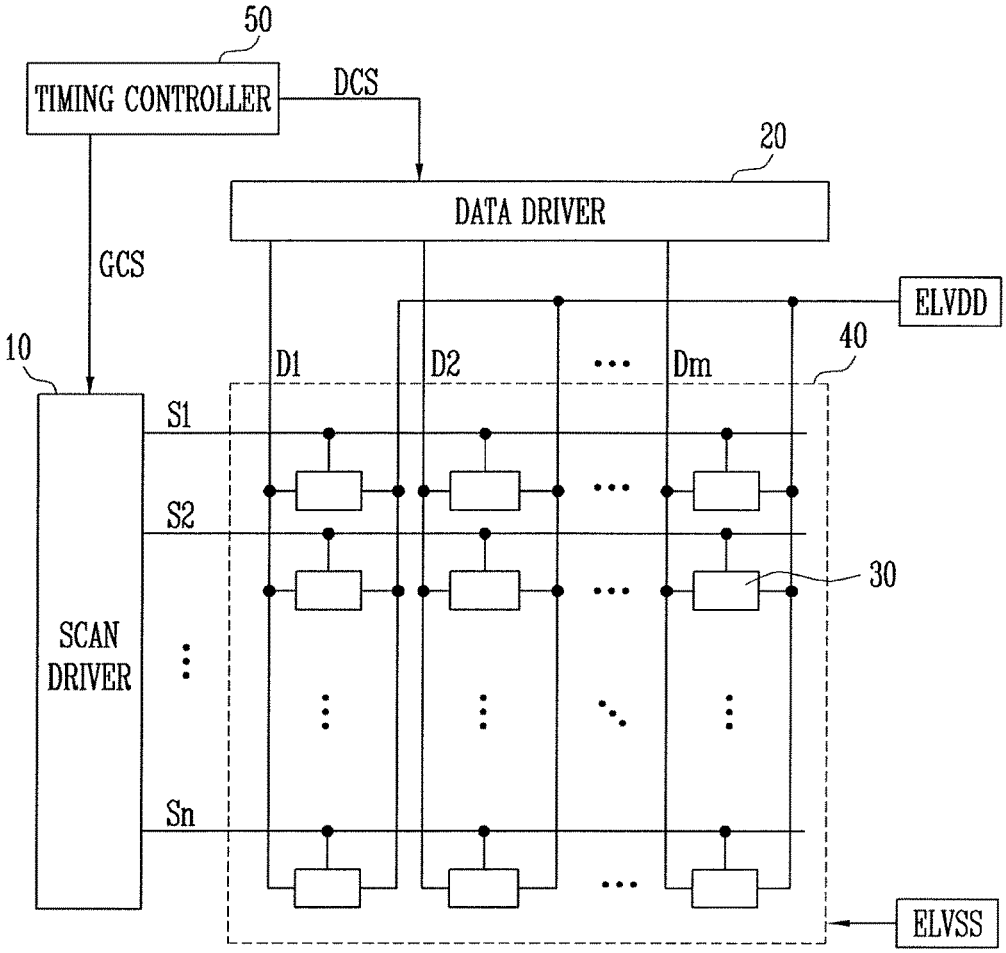
FIG. 1 illustrates an embodiment of a display device.

Example embodiments are described with reference to the drawings; however, they may be embodied in different forms and should not be construed as limited to the embodiments set forth herein. Rather, these embodiments are provided so that this disclosure will be thorough and complete, and will convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device, which, for example, may be an organic light emitting display device or a liquid crystal display device. For illustrative purposes, the display device will be described as an organic light emitting display device.

Referring to FIG. 1, the display device includes a scan driver 10, a data driver 20, a pixel unit 40, and a timing controller 50. The timing controller 50 generates a data driving control signal DCS and a gate driving control signal GCS based on synchronizing signals from an external source. The data driving control signal DCS generated by the timing controller 50 is supplied to the data driver 20. The gate driving control signal GCS is supplied to the scan driver 10.

The data driving control signal DCS may include a source start signal and clock signals. The source start signal controls a sampling start point of time of data. The clock signals may control a sampling operation. The gate driving control signal GCS may include a scan start signal and clock signals. The scan start signal controls first timing of scan signals. The clock signals may used as a basis for shifting the scan start signal.

The scan driver 10 receives the gate driving control signal GCS from the timing controller 50 and supplies the scan signals to scan lines S1 through Sn. For example, the scan driver 10 may sequentially supply the scan signals to the scan lines S1 through Sn. When the scan signals are sequentially supplied to the scan lines S1 through Sn, the pixels 30 are selected in units of horizontal lines. The scan signals may have gate-on voltages (e.g., high voltages) to turn on transistors in the pixels 30.

The data driver 20 receives the data driving control signal DCS from the timing controller 50 and supplies data signals to data lines D1 through Dm. The data signals are supplied from the data lines D1 through Dm to the pixels 30 selected by the scan signals. The data driver 20 may supply the data signals to the data lines D1 through Dm in synchronization with the scan signals.

The pixel unit 40 includes the pixels 30 connected to the scan lines S1 through Sn and the data lines D1 through Dm. The pixel unit 40 receives a first driving power ELVDD and a second driving power ELVSS from at least one external source. Each pixel 30 includes a driving transistor and an organic light emitting diode (OLED). The driving transistor controls the amount of current that flows from the first driving power ELVDD to the second driving power ELVSS, via the OLED, based on a data signal.

In FIG. 1, n scan lines S1 through Sn are illustrated. In one embodiment, no less than one dummy scan line may be additionally formed in the pixel unit 40, for example, based on the circuit structure of the pixels 30.

Figure 2:
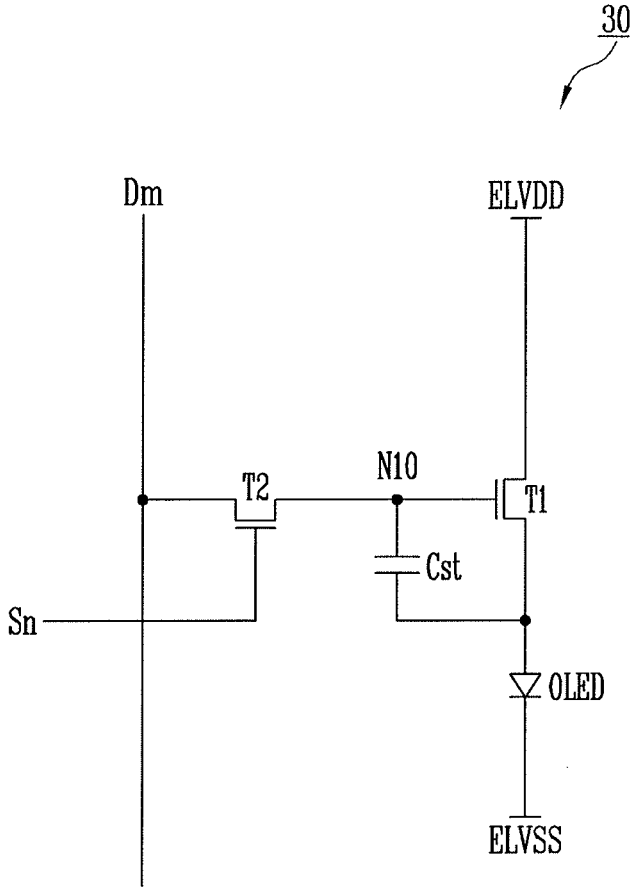
FIG. 2 illustrates an embodiment of a pixel.

FIG. 2 illustrates an embodiment of a pixel, which, for example, may be representative of the pixels 30 in FIG. 1. For convenience sake, the pixel is illustrated as connected to the nth scan line Sn and the mth data line Dm.

Referring to FIG. 2, pixel 30 includes an OLED, a first transistor T1 (driving transistor), a second transistor T2, and a storage capacitor Cst. The OLED includes an anode electrode connected to a second electrode of the first transistor T1 and a cathode electrode connected to the second driving power ELVSS. The OLED generates light with predetermined brightness based on the amount of current from first transistor T1.

The first transistor T1 includes a first electrode connected to the first driving power ELVDD and a second electrode connected to the anode electrode of the OLED. The first transistor T1 includes a gate electrode connected to a tenth node N10. The first transistor T1 controls the amount of current that flows from the first driving power ELVDD to the second driving power ELVSS, via the OLED, based on the voltage of the tenth node N10.

The second transistor T2 includes a first electrode connected to the data line Dm, a second electrode connected to the tenth node N10, and a gate electrode connected to the scan line Sn. When a scan signal is supplied to the scan line Sn, the second transistor T2 is turned on to supply a data signal from data line Dm to tenth node N10.

The storage capacitor Cst is connected between the tenth node N10 and the anode electrode of the OLED. The storage capacitor Cst stores the voltage of the tenth node N10. The pixel 30 may have a different circuit structure in another embodiment, for example, which receives a scan signal.

Figure 3:
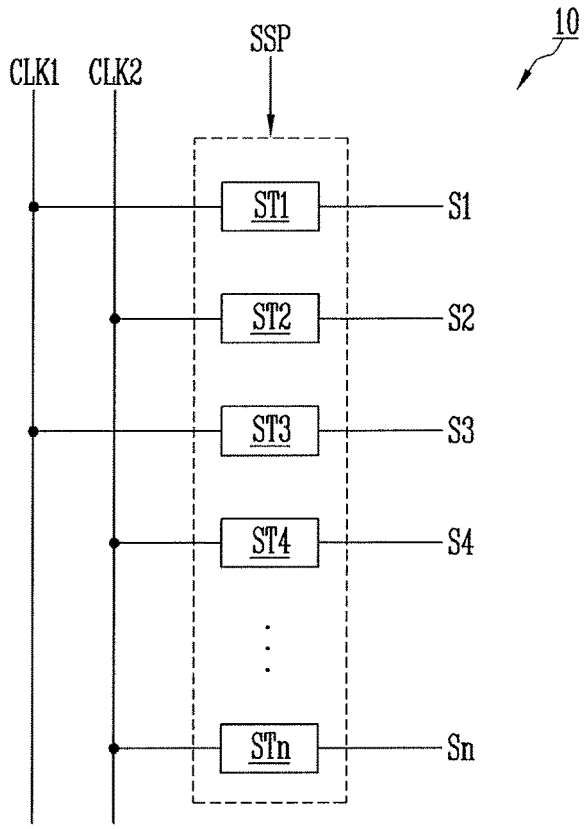
FIG. 3 illustrates an embodiment of a scan driver.

FIG. 3 illustrates an embodiment of the scan driver 10 which includes a plurality of stages ST1 through STn. Each of the stages ST1 through STn is connected to one of the scan lines S1 through Sn. The stages ST1 through STn supply the scan signals to the scan lines S1 through Sn based on a scan start signal SSP. An ith (i is a natural number) stage STi is connected to an ith scan line Si and may supply a scan signal to the ith scan line Si. The scan start signal SSP may be supplied to the first stage ST1 to control the timing of a first scan signal.

Each of the stages ST1 through STn receives a first clock signal CLK1 or a second clock signal CLK2. For example, the odd stages ST1, ST3, . . . may receive the first clock signal CLK1 and the even stages ST2, ST4, . . . may receive the second clock signal CLK2. The first clock signal CLK1 may be, for example, a square wave signal that repeats a high voltage and a low voltage. The high voltage may be, for example, a gate-on voltage and the low voltage may be a gate-off voltage. The second clock signal CLK2 may be, for example, a square wave signal that repeats a high voltage and a low voltage. The high voltage may be, for example, a gate-on voltage and the low voltage may be a gate-off voltage. In one embodiment, the first clock signal CLK1 and the second clock signal CLK2 may have the same period and reversed phases.

In FIG. 3, two clock signals CLK1 and CLK2 are supplied to the scan driver 10. In one embodiment t, the scan driver 10 may receive a different number of (e.g., four) clock signals and different clock signals may be supplied in units of a different number (e.g., four) stages. Thus, the scan driver 10 may receive no less than two clock signals.

In addition, in FIG. 3, n stages ST1 through STn are illustrated. In one embodiment, the scan driver 10 may additionally include a plurality of dummy stages to receive signals from a previous stage and/or a next stage.

Figure 4:
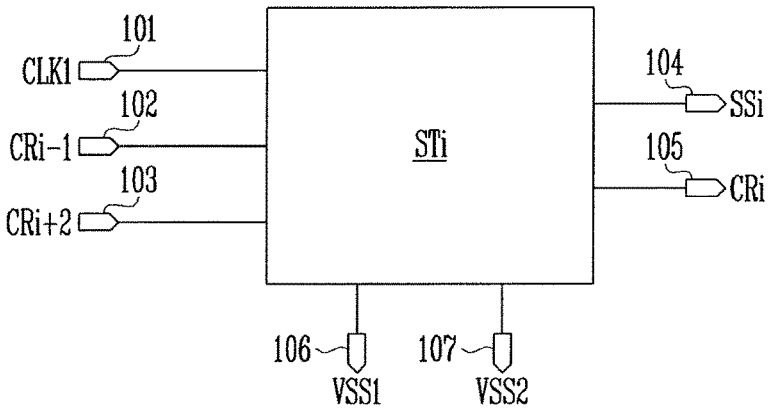
FIG. 4 illustrates an embodiment of terminals connected to a stage.

FIG. 4 illustrates an embodiment of terminals connected to one of the stages, which illustratively corresponds to an ith stage STi. The ith stage STi may be assumed as an odd stage that receives the first clock signal CLK1.

Referring to FIG. 4, the stage STi includes a first input terminal 101, a second input terminal 102, a third input terminal 103, a first output terminal 104, and a second output terminal 105. The first input terminal 101 receives the first clock signal CLK1. The second clock signal CLK2 is supplied to the first input terminal 101 of an (i+1)th stage STi+1.

The second input terminal 102 receives an (i−1)th carry signal CRi−1 from an (i−1)th stage STi−1. When the ith stage STi is the first stage, the scan start signal SSP may be supplied to the second input terminal 102. The (i−1)th carry signal CRi−1 or the scan start signal SSP is supplied to the second input terminal 102 when the first clock signal CLK1 is not supplied to the first input terminal 101 (e.g., when the first input terminal 101 is set to have a gate-off voltage).

The third input terminal 103 receives an (i+2)th carry signal CRi+2 from an (i+2)th stage STi+2. A carry signal of a next stage that is supplied to the third input terminal 103 may be selected as one of carry signals supplied in at least a predetermined time after an ith carry signal CRi is supplied. The predetermined time may correspond, for example, to a time for reducing voltages of the first output terminal 104 and the second output terminal 105 to gate-off voltages. In one embodiment, the predetermined time may be, for example, a 1 horizontal period 1H.

The first output terminal 104 outputs an ith scan signal SSi, which is to be supplied to the ith scan line Si electrically connected to the first output terminal 104.

The second output terminal 105 outputs the ith carry signal CRi, which is to be supplied to the second input terminal 102 of the (i+1)th stage STi+1 and the third input terminal 103 of an (i−2)th stage STi−2.

The stage STi may further include a first power input terminal 106 to receive a first power VSS1 and a second power input terminal 107 to receive a second power VSS2. The first power VSS1 and the second power VSS2 may have, for example, gate-off voltages. The first power VSS1 may have a different (e.g., higher) voltage than the second power VSS2. The first power VSS1 may be set, for example, to −10V, and the second power VSS2 may be set, for example, to −15V. The first power VSS1 and the second power VSS2 may be used to completely turn off the transistors. In one embodiment, the first power VSS1 or the second power VSS2 may be supplied to the first power input terminal 106 and the second power input terminal 107.

Figure 5:
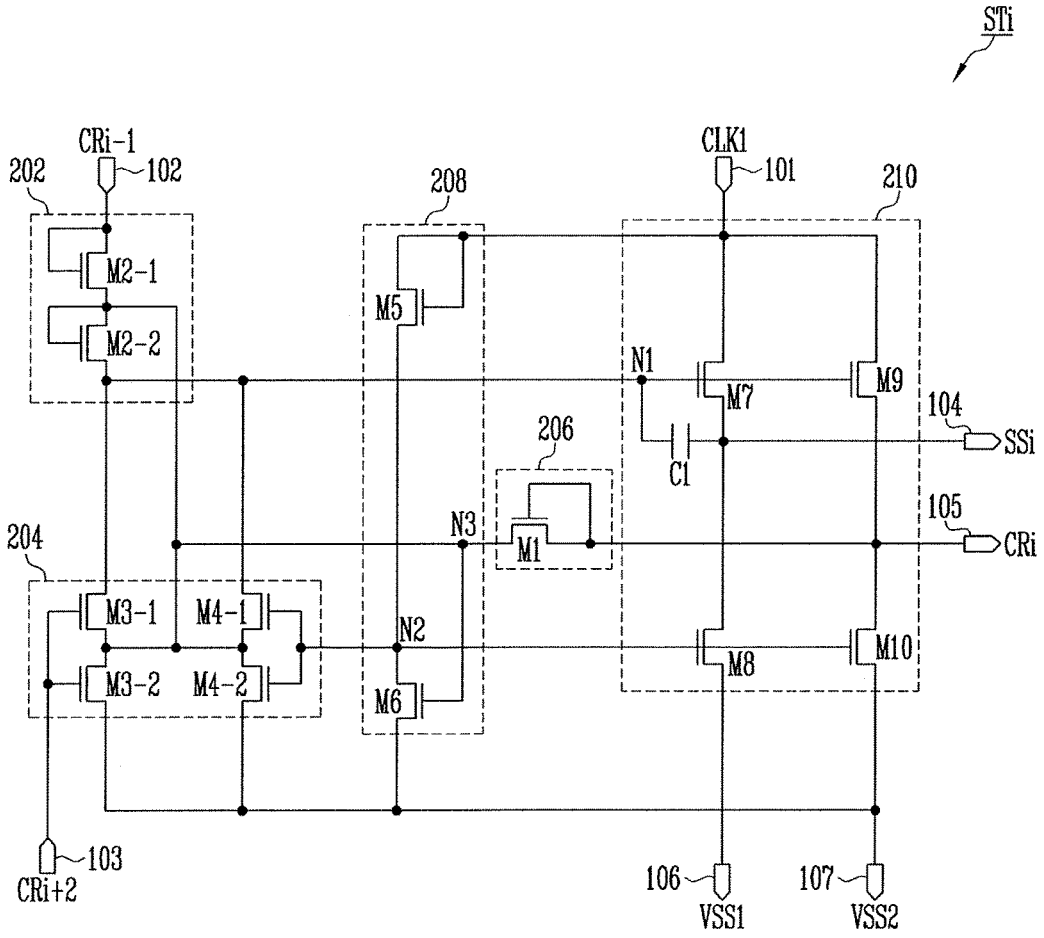
FIG. 5 illustrates an embodiment of a stage.

FIG. 5 illustrates an embodiment of the stage STi in FIG. 4. Referring to FIG. 5, the stage STi includes a first input unit 202, a second input unit 204, a first controller 206, a second controller 208, and an output unit 210. The first input unit 202, the second input unit 204, the first controller 206, the second controller 208, and the output unit 210 may include at least one type of transistor, e.g., NMOS transistor.

The first input unit 202 controls voltages of a first node N1 and a third node N3 based on the (i−1)th carry signal CRi−1 supplied to the second input terminal 102. The first input unit 202 includes a plurality of second transistors M2-1 and M2-2 between the second input terminal 102 and the first node N1. The second transistors M2-1 and M2-2 may be diode-connected to allow current to flow from the second input terminal 102 to the first node N1. A common terminal between the second transistors M2-1 and M2-2 may be electrically connected to the third node N3.

In FIG. 5, the first input unit 202 includes two second transistors M2-1 and M2-2 are illustrated. In one embodiment, the first input unit 202 may include a different number of transistors (e.g., three or more second transistors M2). At least one common terminal among the different number of second transistors M2 may be electrically connected to the third node N3.

The second transistors M2-1 and M2-2 are turned on when the (i−1)th carry signal CRi−1 is supplied to the second input terminal 102. When the second transistors M2-1 and M2-2 are turned on, the (i−1)th carry signal CRi−1 is supplied to the first node N1 and the third node N3.

When the second transistors M2-1 and M2-2 are serially connected between the second input terminal 102 and the first node N1, a voltage between the second input terminal 102 and the first node N1 is divided. As a result, the useful lives of the second transistors M2-1 and M2-2 may increase. In addition, when a voltage of the third node N3 is supplied to the common terminal between the second transistors M2-1 and M2-2, a voltage difference between the second transistors M2-1 and M2-2 may be reduced or minimized, to thereby increase the useful lives of the second transistors M2-1 and M2-2.

In addition, when the voltage of the third node N3 is supplied to the common terminal between the second transistors M2-1 and M2-2, leakage current from the first node N1 to the second input terminal 102 may be reduced or minimized. As a result, operation of the second transistors M2-1 and M2-2 at high temperatures may improve.

The second input unit 204 is connected to the second power input terminal 107. The second input unit 204 controls the voltages of the first node N1 and the third node N3 based on a voltage of a second node N2 and the (i+2)th carry signal CRi+2 supplied to the third input terminal 103. The second input unit 204 includes third transistors M3-1 and M3-2 and fourth transistors M4-1 and M4-2.

The third transistors M3-1 and M3-2 are serially connected between the first node N1 and second power input terminal 107. Gate electrodes of the third transistors M3-1 and M3-2 are connected to the third input terminal 103. The third transistors M3-1 and M3-2 are turned on when the (i+2)th carry signal CRi+2 is supplied to the third input terminal 103 and supply a voltage of the second power VSS2 to the first node N1 and the third node N3. A common terminal between the third transistors M3-1 and M3-2 is electrically connected to the third node N3.

In FIG. 5, the second input unit 204 includes two third transistors M3-1 and M3-2. In one embodiment, the second input unit 204 includes a different number of (e.g., three or more) third transistors M3. At least one common terminal among the different number of third transistors M3 may be electrically connected to the third node N3.

When the third transistors M3-1 and M3-2 are serially connected between the first node N1 and the second power input terminal 107, a voltage between the first node N1 and the second input terminal 107 is divided. As a result, the useful lives of the third transistors M3-1 and M3-2 may increase. In addition, when the voltage of the third node N3 is supplied to the common terminal between the third transistors M3-1 and M3-2, a voltage difference between the third transistors M3-1 and M3-2 may be reduced or minimized. As a result, useful lives of the third transistors M3-1 and M3-2 may increase.

In addition, when the voltage of the third node N3 is supplied to the common terminal between the third transistors M3-1 and M3-2, leakage current from the first node N1 to the second power input terminal 107 may be reduced or minimized. As a result, operation of third transistors M3-1 and M3-2 at high temperature may improve.

The fourth transistors M4-1 and M4-2 are serially connected between the first node N1 and the second power input terminal 107. Gate electrodes of the fourth transistors M4-1 and M4-2 are connected to the second node N2. The fourth transistors M4-1 and M4-2 are turned on or off based on the voltage of the second node N2, in order to control electrical connection among the first node N1, the third node N3, and the second power input terminal 107.

A common terminal between the fourth transistors M4-1 and M4-2 is electrically connected to the third node N3. In FIG. 5, the second input unit 204 includes two fourth transistors M4-1 and M4-2. In one embodiment, the second input unit 204 may include a different number of (e.g., three or more) fourth transistors M4. At least one common terminal among the fourth transistors M4 may be electrically connected to the third node N3.

When the fourth transistors M4-1 and M4-2 are serially connected between the first node N1 and the second power input terminal 107, a voltage between the first node N1 and the second power input terminal 107 is divided. A result, the useful lives of the fourth transistors M4-1 and M4-2 may increase. In addition, when the voltage of the third node N3 is supplied to the common terminal between the fourth transistors M4-1 and M4-2, a voltage difference between the fourth transistors M4-1 and M4-2 may be reduced or minimized. As a result, the useful lives of the fourth transistors M4-1 and M4-2 may increase. When the voltage of the third node N3 is supplied to the common terminal between the fourth transistors M4-1 and M4-2, leakage current from the first node N1 to the second power input terminal 107 may be reduced or minimized. As a result, operation of fourth transistors M4-1 and M4-2 at high temperatures may improve.

The first controller 206 is connected between the second output terminal 105 and the third node N3. The first controller 206 may control the voltage of the third node N3 based on a voltage of the second output terminal 105.

The first controller 206 includes a first transistor M1 connected between the second output terminal 105 and the third node N3. The first transistor M1 includes a gate electrode connected to the second output terminal 105. The first transistor M1 is diode-connected to allow current to flow from the second output terminal 105 to the third node N3, to thereby control the voltage of the third node N3 based on the voltage of the second output terminal 105.

The second controller 208 is connected to the second power input terminal 107. The second controller 208 controls the voltage of the second node N2 based on a voltage of the first input terminal 101 and the voltage of the third node N3.

The second controller 208 includes a fifth transistor M5 and a sixth transistor M6. The fifth transistor M5 is connected between the first input terminal 101 and the second node N2. The fifth transistor M5 includes a gate electrode connected to the first input terminal 101. For example, the fifth transistor m5 may be diode-connected to allow current to flow from the first input terminal 101 to the second node N2. When the first clock signal CLK1 is supplied to the first input terminal 101, the fifth transistor M5 is turned on to supply a voltage of the first clock signal CLK1 to the second node N2.

The sixth transistor M6 is connected between the second node N2 and second power input terminal 107. The sixth transistor M6 includes a gate electrode connected to the third node N3. The sixth transistor M6 is turned on or off based on the voltage of the third node N3, in order to control connection between the second node N2 and the second power input terminal 107.

The output unit 210 is connected to the first power input terminal 106 and the second power input terminal 107. The output unit 210 supplies the ith scan signal SSi to the first output terminal 104 and the ith carry signal CRi to the second output terminal 105 based on a voltage of the first node N1, the voltage of the second node N2, and the first clock signal CLK1 supplied to the first input terminal 101.

The output unit 210 includes a seventh transistor M7, an eighth transistor M8, a ninth transistor M9, a tenth transistor M10, and a first capacitor C1. The seventh transistor M7 is connected between the first input terminal 101 and first output terminal 104. The seventh transistor M7 includes a gate electrode connected to the first node N1. The seventh transistor M7 is turned on or off based on the voltage of the first node N1, in order to control the connection between the first input terminal 101 and the first output terminal 104.

The eighth transistor M8 is connected between the first output terminal 104 and the first power input terminal 106. The eighth transistor M8 includes a gate electrode connected to the second node N2. The eighth transistor m8 is turned on or off based on the voltage of the second node N2 and controls connection between the first output terminal 104 and the first power input terminal 106.

The ninth transistor M9 is connected between the first input terminal 101 and the second output terminal 105. The ninth transistor M9 includes a gate electrode connected to the first node N1. The ninth transistor M9 is turned on or off based on the voltage of the first node N1, in order to control connection between the first input terminal 101 and the second output terminal 105.

The tenth transistor M10 is connected between the second output terminal 105 and the second power input terminal 107. The tenth transistor M10 includes a gate electrode connected to the second node N2. The tenth transistor M10 is turned on or off based on the voltage of the second node N2, in order to control connection between the second output terminal 105 and the second power input terminal 107.

The first capacitor C1 is connected between the first node N1 and the first output terminal 104. The first capacitor C1 functions as a boosting capacitor C1. For example, the first capacitor C1 may increase the voltage of the first node N1 based on an increase in the voltage of the first output terminal 101 when the seventh transistor M7 is turned on, in order to stably maintain the seventh transistor M7 in the turn-on state.

Figure 6:
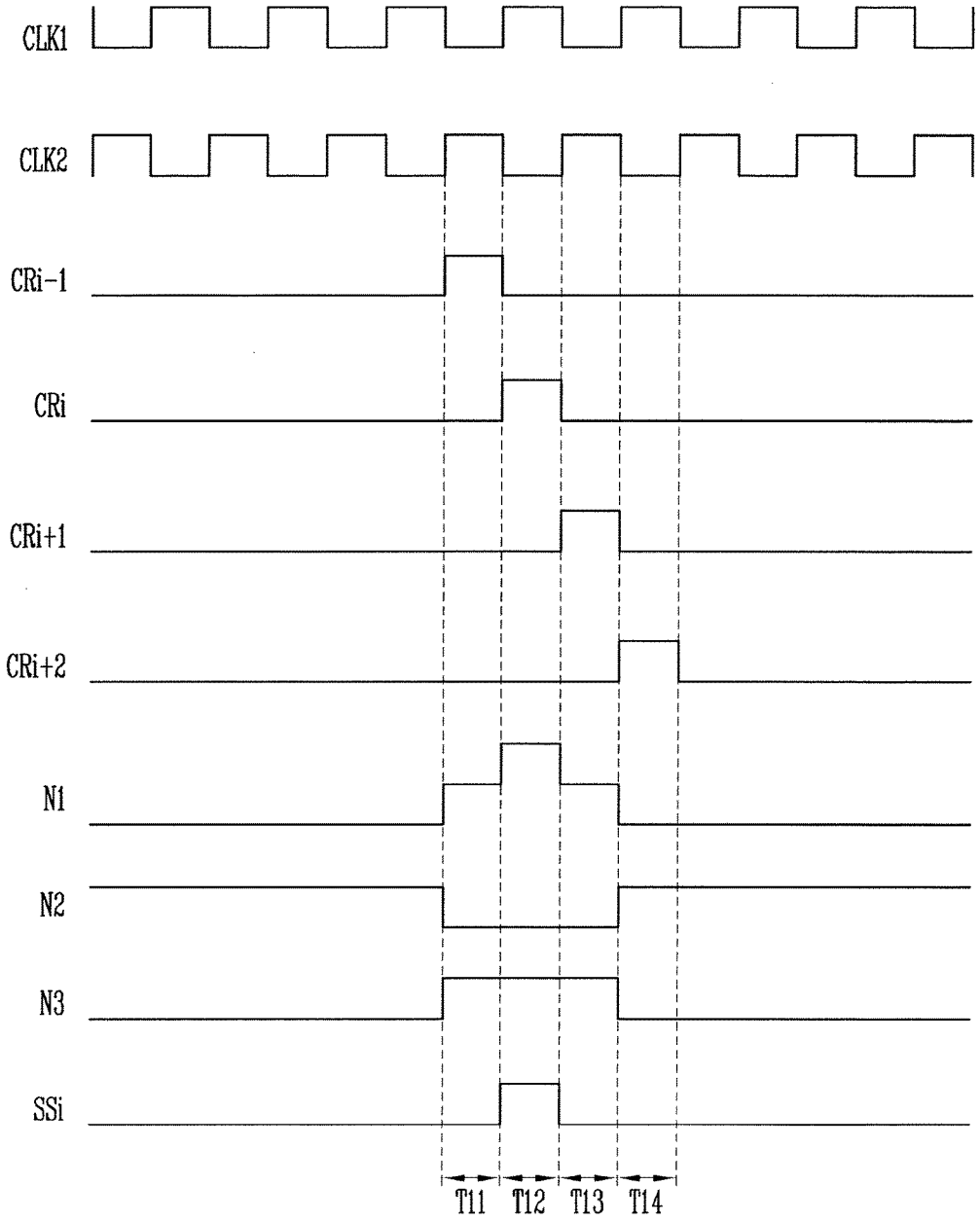
FIG. 6 illustrates an embodiment of signals corresponding to a method for driving a stage.

FIG. 6 illustrates signals corresponding to an embodiment of a method for driving the stage of FIG. 5. Referring to FIG. 6, the first clock signal CLK1 and the second clock signal CLK2 have the same period and reversed phases. When the first clock signal CLK1 (or the second clock signal CLK2) is supplied to the first input terminal 101, the first input terminal 101 has a gate-on voltage. When the first clock signal CLK1 (or the second clock signal CLK2) is not supplied to the first input terminal 101, the first input terminal 101 has a gate-off voltage, for example, the voltage of the second power VSS2.

The second input terminal 102 may have a gate-on voltage when the (i−1)th carry signal CRi−1 is supplied to the second input terminal 102 and may have the voltage of the second power VSS2 in one or more other cases.

The third input terminal 103 may have a gate-on voltage when the (i+2)th carry signal Cri+2 is supplied to the third input terminal 103 and may have the voltage of the second power VSS2 in one or more other cases.

The method initially includes, in a first period T11, supplying the (i−1)th carry signal CRi−1 to the second input terminal 102. When the (i−1)th carry signal CRi−1 is supplied to the second input terminal 102, the second transistors M2-1 and M2-2 are turned on. When the second transistors M2-1 and M2-2 are turned on, a gate-on voltage is supplied to the first node N1.

When the gate on voltage is supplied to the first node N1, the seventh transistor M7 and the ninth transistor M9 are turned on. When the seventh transistor M7 is turned on, the first input terminal 101 and first output terminal 104 are electrically connected. When the ninth transistor M9 is turned on, the first input terminal 101 and the second output terminal 105 are electrically connected. Since the first clock signal CLK1 is not supplied to the first input terminal 101, the first output terminal 104 and second output terminal 105 maintain gate-off voltages (e.g., low voltages).

In addition, the (i−1)th carry signal CRi−1 supplied to the second input terminal 102 is supplied to the third node N3 via the second transistors M2-1 and M2-2. The third node N3 may therefore have a gate-on voltage.

When the gate on voltage is supplied to the third node N3, the sixth transistor M6 is turned on. When the sixth transistor M6 is turned on, the voltage of the second power VSS2 is supplied to the second node N2. When the voltage of the second power VSS2 is supplied to the second node N2, the fourth transistors M4-1 and M4-2, the eighth transistor M8, and the tenth transistor M10 are turned off.

Since the first transistor M1 is diode-connected to allow current to flow from the second output terminal 105 to the third node N3. the gate-on voltage of the third node N3 is not supplied to the second output terminal 105. As a result, the second output terminal 105 may stably maintain a gate-off voltage.

In a second period T12, the first clock signal CLK1 is supplied to the first input terminal 101. Since the seventh transistor M7 and the ninth transistor M9 are in turn-on states, the first clock signal CLK1 supplied to the first input terminal 101 is supplied to the first output terminal 104 and the second output terminal 105. The first clock signal CLK1 supplied to the first output terminal 104 is supplied to the scan line Si as the ith scan signal SSi. The first clock signal CLK1 supplied to the second output terminal 105 is supplied to previous and next stages as the ith carry signal CRi.

In the second period T12, the voltage of the first node N1 is increased to a voltage greater than the first clock signal CLK1, by boosting of the first capacitor C1. As a result, the seventh transistor M7 and the ninth transistor M9 may stably maintain turn-on states.

In the second period T12, the voltage of the third node N3 may have a gate-on voltage based on the first clock signal CLK1 supplied to the second output terminal 105. The gate-on voltage of the third node N3 is supplied to the common terminal between the second transistors M2-1 and M2-2, the common terminal between the third transistors M3-1 and M3-2, and the common terminal between the fourth transistors M4-1 and M4-2.

As a result, the useful lives of the second transistors M2-1 and M2-2, the third transistors M3-1 and M3-2, and the fourth transistors M4-1 and M4-2 may increase. Also, leakage current from the first node N1 may be reduced or minimized and high temperature characteristics and reliability may be improved.

Figure 7:
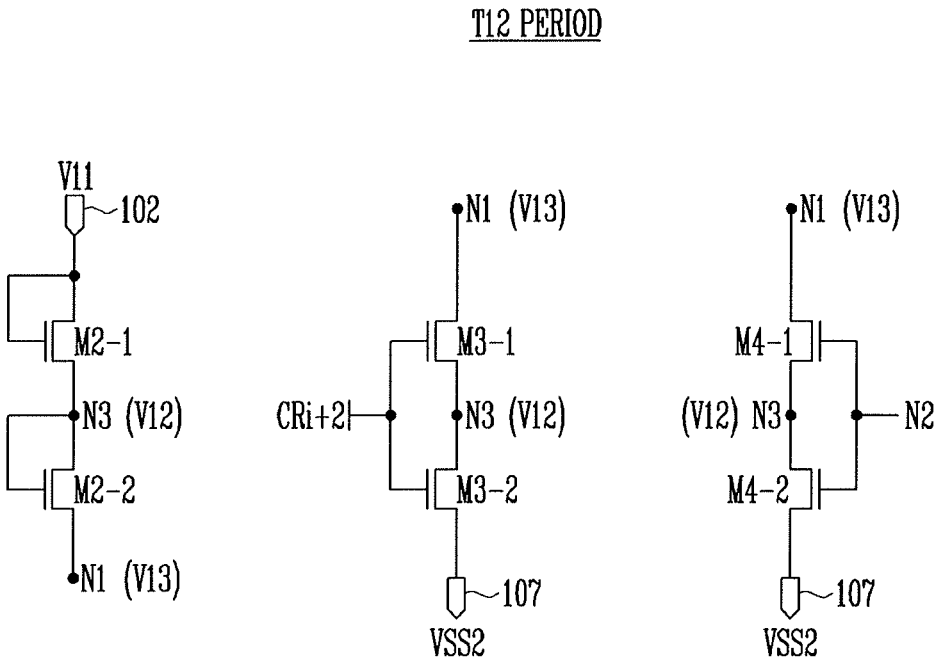
FIG. 7 illustrates signals corresponding to an embodiment of voltages for driving the transistors in the stage of FIG. 6.

As illustrated in FIG. 7, in the second period T12, the (i−1)th carry signal CRi−1 is not supplied to the second input terminal 102. Thus, the second input terminal 102 may have a gate-off voltage. For example, in the second period T12, the second input terminal 102 may have a predetermined $11^{th}$ voltage V11.

In the second period T12, the first node N1 may have a voltage greater than the first clock signal CLK1 by boosting of the first capacitor C1. For example, in the second period T12, the first node N1 may have a $13^{th}$ voltage V13 greater than $11^{th}$ voltage V11. In addition, in the second period T12, the voltage of the third node N3 may have a gate-on voltage that corresponds to the first clock signal CLK1, for example, a $12^{th}$ voltage V12. In one embodiment, the $12^{th}$ voltage V12 may be greater than the $11^{th}$ voltage V11 and lower than the $13^{th}$ voltage V13.

Therefore, in the second period T2, the voltage difference between the $11^{th}$ voltage V11 and the $12^{th}$ voltage V12 may be applied to the first second transistor M2-1. Also, the voltage difference between the $12^{th}$ voltage V12 and the $13^{th}$ voltage V13 may be applied to the second transistor M2-2. The voltage differences respectively applied to the second transistors M2-1 and M2-2 are reduced or minimized. As a result, the useful lives of the second transistors M2-1 and M2-2 may increase. In addition, leakage current from the first node N1 may be reduced or minimized based on a voltage difference between the first node N1 and third node N3. As a result, high temperature characteristics may be improved.

For example, when the voltage of the third node N3 is not applied to the common terminal between the second transistors M2-1 and M2-2, the voltage difference between the $11^{th}$ voltage V11 and the $13^{th}$ voltage V13 is applied between the second transistors M2-1 and M2-2. The second transistors M2-1 and M2-2 may rapidly deteriorate due to the high voltage difference. In addition, due to the voltage difference between the $11^{th}$ voltage V11 and the $13^{th}$ voltage V13, a large amount of leakage current may flow from the first node N1 to the second input terminal 102. As a result, reliability of the stage may deteriorate.

In accordance with one or more embodiments, when the voltage of the third node N3 is applied to the common terminal between the second transistors M2-1 and M2-2, the voltage differences of the second transistors M2-1 and M2-2 may be reduced or minimized. Also, the useful lives of the second transistors M2-1 and M2-2 may increase and leakage current flowing from the first node N1 to the second input terminal 102 may be reduced or minimized. As a result, reliability of the stage may be increased.

In the second period T12, the voltage difference between the $13^{th}$ voltage V13 and the $12^{th}$ voltage V12 is applied to the first third transistor M3-1 and a voltage difference between the $12^{th}$ voltage V12 and the second power VSS2 is applied to the second third transistor M3-2. The second voltage VSS2 may be a voltage less than the $12^{th}$ voltage V12, for example, the $11^{th}$ voltage V11. The voltage differences respectively applied to the third transistors M3-1 and M3-2 may be reduced or minimized, to thereby increase the useful lives of the third transistors M3-1 and M3-2. In addition, leakage current from the first node N1 may be reduced or minimized based on the voltage difference between the first node N1 and the third node N3. As a result, high temperature characteristics may improve.

In the second period T12, the voltage difference between the $13^{th}$ voltage V13 and the $12^{th}$ voltage V12 is applied to the first fourth transistor M4-1 and the voltage difference between the $12^{th}$ voltage V12 and the second power VSS2 is applied to the second fourth transistor M4-2. The voltage differences respectively applied to the fourth transistors M4-1 and M4-2 may be reduced or minimized. As a result, the useful lives of the fourth transistors M4-1 and M4-2 may increase. In addition, leakage current from the first node N1 may be reduced or minimized based on the voltage difference between the first node N1 and third node N3. Thus, high temperature characteristics may improve.

In the second period T12, the fifth transistor M5 is turned on based on the first clock signal CLK1 supplied to the first input terminal 101. When the fifth transistor M5 is turned on, the first clock signal CLK1 is supplied to the second node N2. In the second period T12, the sixth transistor M6 maintains a turn-on state based on the voltage of the third node N3.

The fifth transistor M5 is diode-connected. Therefore, when the fifth transistor M5 and the sixth transistor M6 have similar channel widths, the voltage of the second node N2 may maintain the voltage of the second power VSS2. For example, in the second period T12, the second node N2 may stably maintain the voltage of the second power VSS2, even though the fifth transistor M5 is turned on.

In a third period T13, supply of the first clock signal CLK1 to the first input terminal 101 is stopped to set the first input terminal 101 to a gate-off voltage. Since the seventh transistor M7 and the ninth transistor M9 are in turn-on states, the gate-off voltage is supplied to the first output terminal 104 and the second output terminal 105. Thus, in the third period T13, the voltage of the first output terminal 104 is supplied to the first input terminal 101 via the seventh transistor M7. In the third period T13, the voltage of the second output terminal 105 is supplied to the first input terminal 101 via the ninth transistor M9.

Therefore, in the third period T13, supply of the ith scan signal SSi to the first output terminal 104 is stopped and supply of the ith carry signal CRi to the second output terminal 105 is stopped. In addition, in the third period T13, the voltage of the first node N1 is also reduced based on the reduction in voltage of the first output terminal 104.

In accordance with one or more embodiments, the first output terminal 104 and the second output terminal 105 are pulled up and down by the seventh transistor M7 and ninth transistor M9. Therefore, in order secure stable driving, the size (e.g., W/L) of the seventh transistor M7 may be greater than the size of the eighth transistor M8. In addition, in order to secure stable driving, the size (e.g., W/L) of the ninth transistor M9 may be greater than the size of tenth transistor M10. Then, for a predetermined period (e.g., 1H), the first output terminal 104 and the second output terminal 105 may be stably pulled up or down, so that stable driving may be secured.

In a fourth period T14, the (i+2)th carry signal CRi+2 is supplied to the third input terminal 103. When the (i+2)th carry signal CRi+2 is supplied to the third input terminal 103, the third transistors M3-1 and M3-2 are turned on. When the third transistors M3-1 and M3-2 are turned on, the voltage of the second power VSS2 is supplied to the first node N1 and the third node N3.

When the voltage of the second power VSS2 is supplied to the first node N1, the seventh transistor M7 and ninth transistor M9 are turned off. When the voltage of the second power VSS2 is supplied to third node N3, the sixth transistor M6 is turned off.

In the fourth period T14, the first clock signal CLK1 is supplied to the first input terminal 101. When the first clock signal CLK1 is supplied to the first input terminal 101, the fifth transistor M5 is turned on. When the fifth transistor M5 is turned on, the second node N2 is set to have a gate-on voltage based on the first clock signal CLK1. When the second node N2 is set to have the gate-on voltage, the fourth transistors M4-1 and M4-2, the eighth transistor M8, and the tenth transistor M10 are turned on.

When the fourth transistors M4-1 and M4-2 are turned on, the voltage of the second power VSS2 is supplied to the first node N1. When the eighth transistor m8 is turned on, the voltage of the first power VSS1 is supplied to the first output terminal 104. When the tenth transistor M10 is turned on, the voltage of the second power VSS2 is supplied to the second output terminal 105.

In the fourth period T14, the voltage of the second power VSS2 is supplied to the first node N1 and the voltage of the first power VSS1 is supplied to the first output terminal 104. For example, in the fourth period T14, the voltage of the second power VSS2 is supplied to the gate electrode of the seventh transistor M7 and the voltage of the first power VSS1 greater than the voltage of the second power VSS2 is supplied to a second electrode of the seventh transistor M7. Therefore, in the fourth period T14, the seventh transistor M7 may be in a complete turn-off state.

In accordance with one or more of the aforementioned embodiments, stages output the scan signals SS and the carry signals CR while repeating the first period T11 through the fourth period T14.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, drivers, and signal generating and processing features of the disclosed embodiments may be implemented in logic which, for example, may include hardware, software, or both. When implemented at least partially in hardware, the controllers, drivers, and signal generating and processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, and signal generating and processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A stage, comprising:

an output connected to a first power input terminal and a second power input terminal, the output to supply an ith (i is a natural number) scan signal to a first output terminal and an ith carry signal to a second output terminal based on a voltage of a first node, a voltage of a second node, and a first clock signal supplied to a first input terminal;

a first controller connected between a second output terminal and a third node, the first controller to control a voltage of the third node based on a voltage of the second output terminal;

a second controller connected to the second power input terminal, the second controller to control the voltage of the second node based on the first clock signal supplied to the first input terminal and the voltage of the third node;

a first input to control the voltages of the first node and the third node based on a carry signal of a previous stage supplied to a second input terminal; and a second input connected to the second power input terminal, the second input to control the voltages of the first node and the third node based on the voltage of the second node and a carry signal of a next stage supplied to a third input terminal.

2. The stage as claimed in claim 1, wherein the carry signal of the previous stage does not overlap the first clock signal.

3. The stage as claimed in claim 1, wherein the carry signal of the previous stage corresponds to an (i−1)th carry signal.

4. The stage as claimed in claim 1, wherein the carry signal of the next stage is to be supplied in at least a first period after the ith carry signal is supplied.

5. The stage as claimed in claim 4, wherein the first period is a 1 horizontal period 1H.

6. The stage as claimed in claim 1, wherein the carry signal of the next stage corresponds to an (i+2)th carry signal.

7. The stage as claimed in claim 1, wherein:

the first power input terminal is to receive a first power set to have a gate-off voltage, and the second power input terminal is to receive a second power set to have a gate-off voltage less than a voltage of the first power.

8. The stage as claimed in claim 1, wherein:

the first power input terminal and the second power input terminal are connected to a same power, and the same power has a gate-off voltage.

9. The stage as claimed in claim 1, wherein the first controller includes:

a first transistor connected between the second output terminal and the third node, wherein the first transistor includes a gate electrode connected to the second output terminal.

10. The stage as claimed in claim 1, wherein:

the first input includes a plurality of second transistors between the second input terminal and the first node, the second transistors diode-connected to allow current to flow from the second input terminal to the first node, and at least one common terminal between adjacent ones of the second transistors is electrically connected to the third node.

11. The stage as claimed in claim 1, wherein the second input includes:

a plurality of third transistors serially connected between the first node and the second power input terminal, the third transistors including gate electrodes connected to the third input terminal; and a plurality of fourth transistors serially connected between the first node and the second power input terminal, the fourth transistors including gate electrodes connected to the second node, wherein at least one common terminal between adjacent ones of the third transistors and at least one common terminal between adjacent ones of the fourth transistors are electrically connected to the third node.

12. The stage as claimed in claim 1, wherein the second controller includes:

a fifth transistor connected between the second node and the first input terminal, the first transistors including a gate electrode connected to the first input terminal; and a sixth transistor connected between the second node and the second input terminal, the sixth transistor including a gate electrode connected to the third node.

13. The stage as claimed in claim 1, wherein the output includes:

a seventh transistor connected between the first input terminal and the first output terminal, the seventh transistor including a gate electrode connected to the first node;

an eighth transistor connected between the first output terminal and the first power input terminal, the eighth transistor including a gate electrode connected to the second node;

a ninth transistor connected between the first input terminal and the second output terminal, the ninth transistor including a gate electrode connected to the first node;

a tenth transistor connected between the second output terminal and the second power input terminal, the tenth transistor including a gate electrode connected to the second node; and a first capacitor connected between the first node and the first output terminal, wherein a size of the seventh transistor is greater than a size of the eighth transistor, and wherein a size of the ninth transistor is greater than a size of the tenth transistor.

14. A display device, comprising:

a plurality of pixels connected to scan lines and data lines;

a data driver to supply data signals to the data lines; and a scan driver including a plurality of stages to supply scan signals to the scan lines, wherein an ith (i is a natural number) stage among the stages includes:

an output connected to a first power input terminal and a second power input terminal, the output to supply an ith (i is a natural number) scan signal to a first output terminal and an ith carry signal to a second output terminal based on a voltage of a first node, a voltage of a second node, and a clock signal supplied to a first input terminal;

a first controller connected between a second output terminal and a third node, the first controller to control a voltage of the third node based on a voltage of the second output terminal;

a second controller connected to the second power input terminal, the second controller to control the voltage of the second node based on the clock signal supplied to the first input terminal and the voltage of the third node;

a first input to control the voltages of the first node and the third node based on a carry signal of a previous stage supplied to a second input terminal; and a second input connected to the second power input terminal, the second input to control the voltages of the first node and the third node based on the voltage of the second node and a carry signal of a next stage supplied to a third input terminal, wherein the first power input terminal and the second power input terminal are to receive gate-off voltages.

15. The display device as claimed in claim 14, wherein:

a first clock signal is to be supplied to the first input terminal of the ith stage and a second clock signal is supplied to a first input terminal of an (i+1)th stage; and the first clock signal and the second clock signal have a same period and reversed phases.

16. The display device as claimed in claim 14, wherein:

the first controller includes a first transistor connected between the second output terminal and the third node, and the first transistor including a gate electrode connected to the second output terminal.

17. The display device as claimed in claim 14, wherein:

the first input includes a plurality of second transistors between the second input terminal and the first node, the second transistors diode-connected to allow current to flow from the second input terminal to the first node, and at least one common terminal between adjacent ones of the second transistors is electrically connected to the third node.

18. The display device as claimed in claim 14, wherein the second input includes:

a plurality of third transistors serially connected between the first node and the second power input terminal, the third transistors including gate electrodes connected to the third input terminal; and a plurality of fourth transistors serially connected between the first node and the second power input terminal, the fourth transistors including gate electrodes connected to the second node, wherein at least one common terminal between adjacent ones of the third transistors and at least one common terminal between adjacent ones of the fourth transistors are electrically connected to the third node.

19. The display device as claimed in claim 14, wherein the second controller includes:

a fifth transistor connected between the second node and the first input terminal, the fifth transistor includes a gate electrode connected to the first input terminal; and a sixth transistor connected between the second node and the second input terminal, the sixth transistor including a gate electrode connected to the third node.

20. The display device as claimed in claim 14, wherein the output includes:

a seventh transistor connected between the first input terminal and the first output terminal, the seventh transistor including a gate electrode connected to the first node;

an eighth transistor connected between the first output terminal and the first power input terminal, the eighth transistor including a gate electrode connected to the second node;

a ninth transistor connected between the first input terminal and the second output terminal, the ninth transistor including a gate electrode connected to the first node;

a tenth transistor connected between the second output terminal and the second power input terminal, the tenth transistor including a gate electrode connected to the second node; and a first capacitor connected between the first node and the first output terminal, wherein a size of the seventh transistor is greater than a size of the eighth transistor, and wherein a size of the ninth transistor is greater than a size of the tenth transistor.

* * * * *